United States Patent [19]

Noble, Sr.

[11] Patent Number: 4,819,816

[45] Date of Patent: Apr. 11, 1989

[54] COMBINATION SHIPPING RACK AND SUPPORT PALLET CONSTRUCTION

[75] Inventor: William L. Noble, Sr., Village of Wolverine Lake, Mich.

[73] Assignee: Chrysler Motors Corporation, Highland Park, Mich.

[21] Appl. No.: 156,764

[22] Filed: Feb. 17, 1988

[51] Int. Cl.[4] ..... A47B 47/00

[52] U.S. Cl. ..... 211/189; 211/195

[58] Field of Search ..... 211/189, 191, 195; 280/79.3; 108/56.3, 56.1

[56] References Cited

U.S. PATENT DOCUMENTS

| | | | |
|---|---|---|---|
| 2,974,917 | 3/1961 | Kappen | 108/56.1 |
| 3,580,602 | 5/1971 | Hebert | 211/189 X |
| 3,776,146 | 12/1973 | Morrison | 108/52.1 X |
| 3,981,249 | 9/1976 | Herrmann et al. | 108/52.1 |
| 4,145,975 | 3/1987 | Colbert | 108/52.1 |
| 4,538,950 | 9/1985 | Shiomi et al. | 108/53.1 X |
| 4,699,280 | 10/1987 | Hoss | 211/195 |

*Primary Examiner*—Reinaldo P. Machado
*Assistant Examiner*—Sarah A. Lechok Eley
*Attorney, Agent, or Firm*—Edward A. Craig

[57] ABSTRACT

A combination is provided comprising a shipping rack and a support pallet therefor. The shipping rack includes a bottom wall and upstanding end walls. The shipping rack is provided with casters so that it may be rolled along a surface. The pallet includes support structure for holding the shipping rack slightly above the ground when the pallet is placed therebeneath so that the casters do not engage the ground thereby preventing unwanted movement of the shipping rack.

3 Claims, 2 Drawing Sheets

COMBINATION SHIPPING RACK AND SUPPORT PALLET CONSTRUCTION

BACKGROUND OF THE INVENTION

1 Field of the Invention

This invention relates to a shipping rack having casters and a support pallet therefor to raise the rack and its casters out of ground engagement when it is desired to prevent rolling of the rack along a surface.

2. Prior Art

Racks of the type to which the present invention relates are commonly used for shipping industrial parts. The parts are normally elongated members which do not easily fit into box-like containers. For example, automobile bumpers are elongated and have a curved configuration which does not readily adapt to shipment in box-like containers. The racks used for this purpose normally have a bottom wall and upstanding end walls but not side walls (although the invention is applicable to a rack having side walls). The elements to be shipped can be easily loaded onto the racks with the racks giving vertical and end-wise support. A rack construction of this general character is disclosed in U.S. Pat. No. 4,699,280. The present invention is concerned with such a rack which also has casters to permit rolling of the rack on a surface either by pushing or pulling so that the rack may be easily moved to the desired location in an industrial plant.

One problem which has been encountered in connection with castered racks is that it is difficult to transport such racks in semi-trailers or railroad box cars without the rack undesirably shifting position during such freighting operation. Various blocking techniques have been used in the past. However, such techniques have resulted in additional transportation expense. The present invention provides a support pallet for a castered rack which will cause the rack to be lifted out of engagement with the ground to thereby prevent rolling of the casters. A pallet having the general configuration desired in accordance with the present invention is illustrated in U.S. Pat. No. 4,145,975. However, this pallet is not disclosed as having the dimensional characteristics necessary for functioning in accordance with the present invention, nor is the function aspect of the present invention disclosed.

The combination in accordance with the present invention has the advantage of being easily manufactured by a brake forming press, of being fabricated of a single metal plate and thus being very durable and having a configuration which makes it self-nesting and therefore easily stackable for storage purposes. The rack is easily handled with one setting of a fork lift and is handleable as a unit of both the rack and pallet or as a rack alone. Further, the pallet may be used as a standard pallet when desired.

SUMMARY OF THE INVENTION

The combination of the present invention comprises a shipping rack and a support pallet therefor. The shipping rack includes a generally rectangular bottom wall having a width and a length defining four corners. An upstanding end wall is provided at each end of the length of the bottom wall. At least four spaced apart casters are provided on the underside of the bottom wall each being positioned adjacent to one of the corners. The casters are normally ground engaging to permit the shipping rack to be rolled along a surface.

The pallet includes a generally flat support shelf. A downwardly extending trough extends along each of two opposed edges of the support shelf. A generally flat support wing extends from one of the troughs in the same plane as the support shelf. Preferably, such a support wing is provided for each of the troughs.

The troughs have a depth greater than the distance from the underside of the shipping rack bottom wall to the bottom of the casters. The pallet is receivable beneath the shipping rack between the pairs of casters at each longitudinal end of the shipping rack with the shipping rack being supported by said support shelf and support wing or wings and with the casters out of ground engagement. The troughs are spaced apart a distance to accommodate reception of the fingers of a fork lift so that the shipping rack may be lifted from the support pallet. At least one of the wings is positioned with respect to the space beneath the support shelf to accommodate reception of one finger of a fork lift therebeneath with the other finger of a fork lift being received beneath the support shelf so that the support pallet and shipping rack may be lifted as a unit. The troughs are generally V-shaped so that pallets can be nested one on top of the other.

DETAILED DESCRIPTION OF A PREFERRED EMBODIMENT

Figure 1:
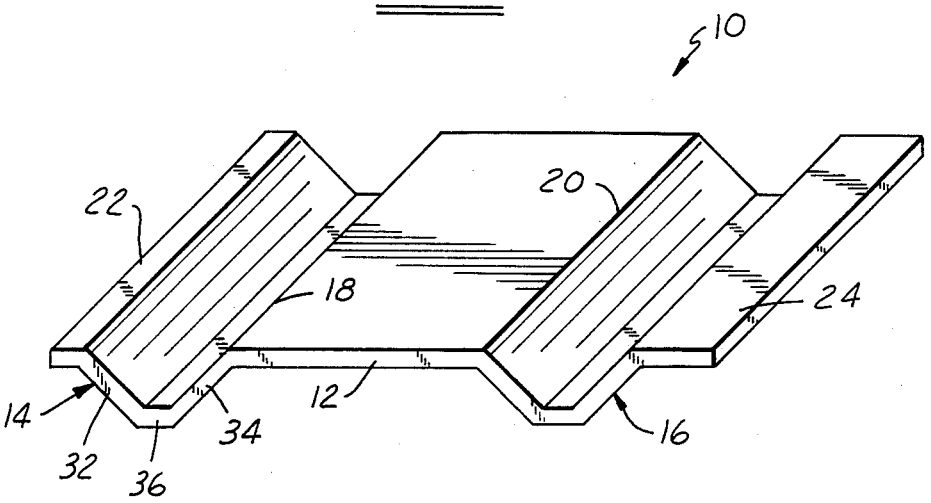
FIG. 1 is a view in perspective of a support pallet forming one embodiment of the present invention.

The support pallet 10 of the present invention is best shown in FIG. 1. As will be therein noted, the pallet 10 is fabricated of a single piece of material, preferable plate steel, having a thickness of about one-half inch for strength. In its unformed shaped the plate may have typically a width of seventy-two inches and a length of eighty inches. After being formed, the pallet may be sixty-eight inches in length and six inches in depth.

The steel plate is formed into the configuration shown in FIG. 1 as by means of brake press forming. The support pallet 10 includes a generally flat central support shelf 12. A downwardly extending trough 14, 16 extends along each of two opposed edges 18, 20 of the support shelf 12. A generally flat support wing 22, 24 extends from the edges 26, 28 of each of the troughs 14, 16. The wings 22, 24 are in the same plane as that defined by the support shelf 12. As a consequence, the shelf 12 and wings 22, 24 form a support structure at the same vertical level. This structure is ultimately used to support the shipping rack 30 illustrated in FIG. 2. Each trough 14, 16 has a general V-shape comprising downwardly and inwardly angled side walls 32, 34 terminating in flat bottom wall 36. This construction permits nesting of pallets 10, one upon the other, so that they may be vertically stacked for storage or shipping purposes.

Figure 2:
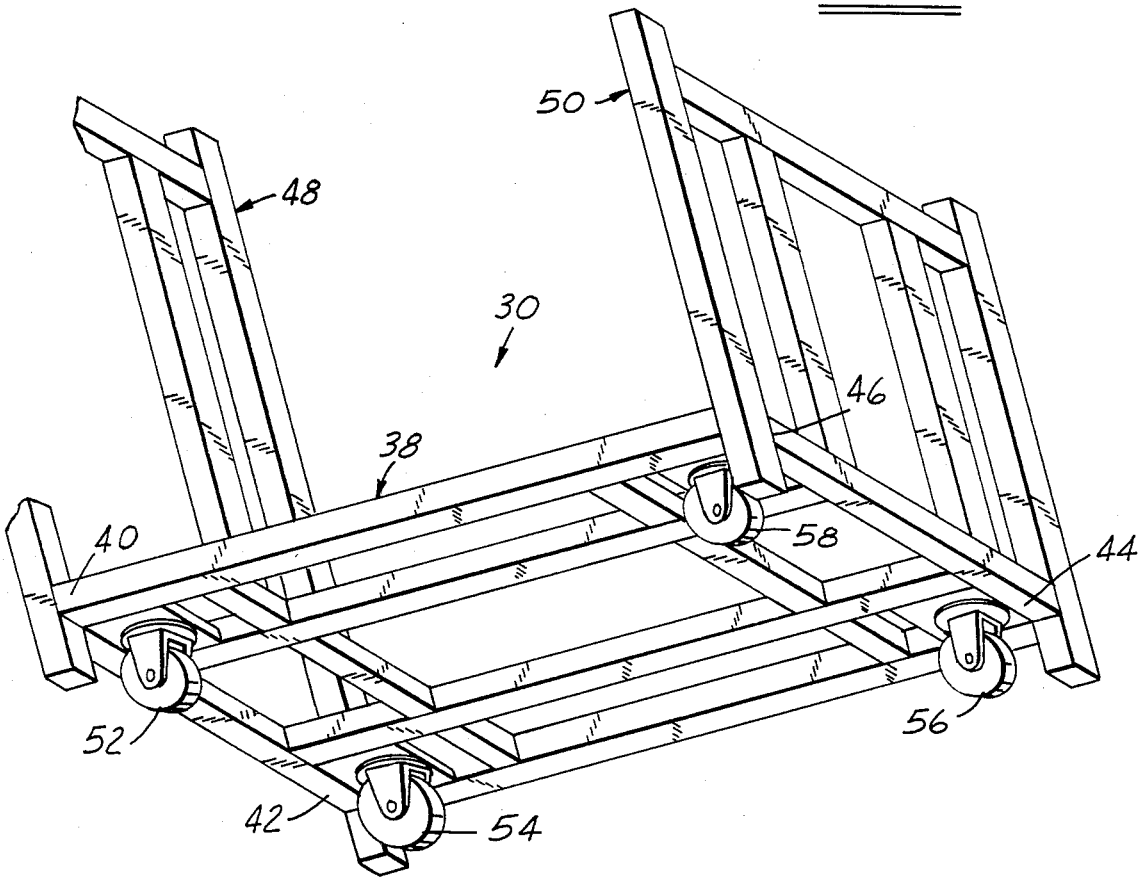
FIG. 2 is a perspective view of a shipping rack used in combination with the support pallet of FIG. 1.

Referring now to FIG. 2, it will be noted that the shipping rack 30 comprises a generally rectangular bottom wall 38 having a width and a length defining four corners 40, 42, 44, 46. An upstanding end wall 48, 50 is provided at each end of the length of the bottom wall 38. Four spaced apart casters 52, 54, 56, 58 are provided on the underside of the bottom wall 38. Each caster is positioned adjacent to one of the corners 40, 42, 44, 46. The casters are normally ground engaging to permit the shipping rack 30 to be rolled along a surface as desired by either pushing or pulling. This is normally done within an industrial plant to move the shipping rack 30 to whatever location is desired. The shipping rack is normally loaded with articles which are not readily adapted to storage in a bin or box-like structure. Such articles may be, for example, automobile bumpers, sheet metal parts such as doors and fenders and the like. These parts are easily loaded and unloaded from the open sides of the shipping rack.

Figure 3:
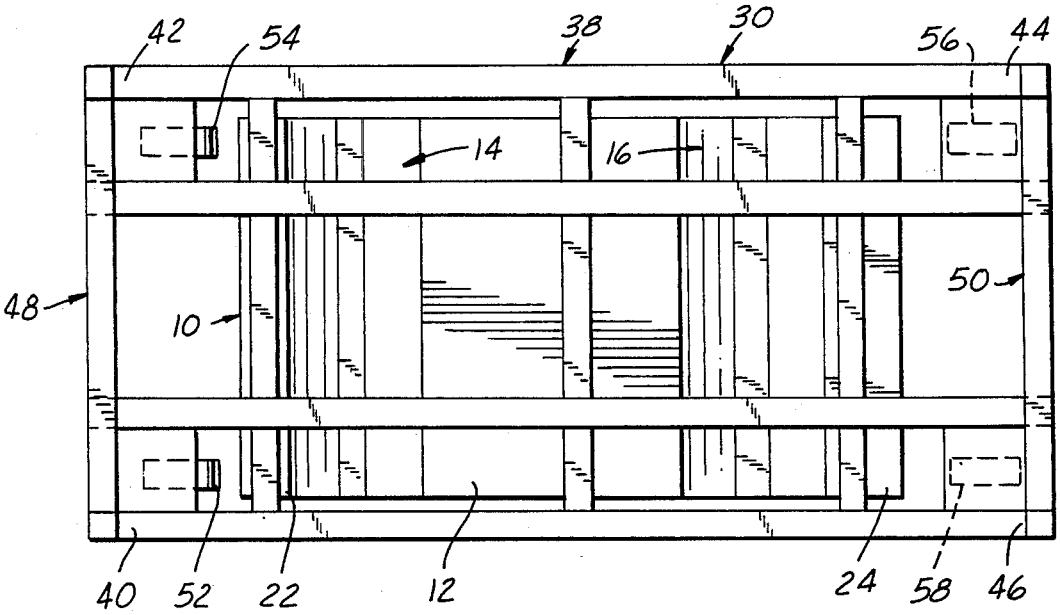
FIG. 3 is a top-plan view of the shipping rack with the support pallet positioned therebeneath.
Figure 4:
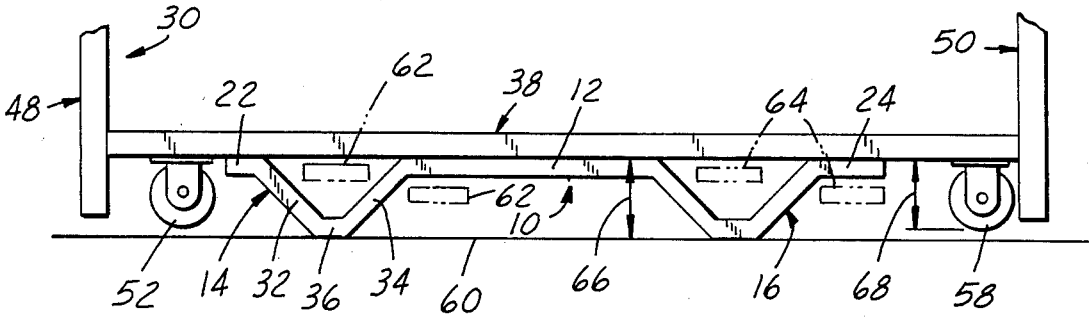
FIG. 4 is a side-elevational view of the combination of FIG. 3.

Referring now to FIGS. 3 and 4, it will be noted that the support pallet 10 is receivable beneath the shipping rack 30 between the pairs of casters 52, 54 and 56, 58 at each longitudinal end of the shipping rack 30 with the shipping rack 30 being supported by the support shelf 12 and support wings 22, 24. As will be noted, the casters 52, 54, 56, 58 are out of ground engagement with the surface 60. The term "ground" is used to denote any type of such surface whether the actual ground, a paved surface, a plant floor or the like. The shipping rack 30 is loaded onto the support pallet 10 as by means of a fork lift of the type in common use in industrial plants. Such fork lifts have a fork including a pair of outwardly extending spaced apart fingers 62, 64 as shown in FIG. 4. The shipping rack 30 may simply be lifted by such a fork lift and placed on a support pallet 10.

As shown in FIG. 4, when the shipping rack 30 is placed on a support pallet 10, the casters 52. 54. 56, 58 are out of ground engagement. This occurs because the distance indicated by line 66, which is equal to the depth of the troughs 14, 16, is greater than the distance indicated by the line 68, which is the distance from the underside of the shipping rack bottom wall 36 to the bottom of the casters.

The troughs 14, 16 are spaced apart a distance to accommodate reception of the spaced apart lift fingers 62, 64 as shown in FIG. 4 in dotted lines, so that the shipping rack 30 may be lifted from the support pallet 10. This permits independent manipulation of the shipping rack 30. The support wing 24 is positioned with respect to the space beneath the support shelf 12 to accommodate reception of one finger 64 of a fork lift with the other finger 62 being received beneath the support shelf 12 so that the support pallet 10 and shipping rack 30 may be lifted as a unit with the fingers of the fork lift being spaced apart the same distance used for lifing the rack. Thus, the combined support pallet 10 and shipping rack 30 may be moved as a unit or the shipping rack 30 may be moved separately. In this respect, it should be noted that the wing 24 is slightly wider than the wing 22 in order to accommodate the width of the fork lift finger 64. Both wings may be widened if desired so that each may accommodate a fork lift finger.

I claim:

1. The combination comprising a shipping rack and support pallet therefor, the shipping rack including a generally rectangular bottom wall having a width and a length defining four corners, an upstanding end wall at each end of the length of the bottom wall, at least four spaced apart casters on the underside of the bottom wall each being positioned adjacent to one of said corners, the casters normally being ground engaging to permit the shipping rack to be rolled along a surface, the pallet being fabricated of a single metallic plate having a width and a length and including a generally flat support shelf, a downwardly extending trough extending transversely of the pallet along each of two opposed edges of said support shelf, a generally flat support wing extending from one of the troughs in the same plane as that defined by any support shelf, the troughs having a depth greater than the distance from the underside of the shipping rack bottom wall to the bottom of the casters, the pallet being received beneath the shipping rack between the pairs of casters at each longitudinal end of the shipping rack with the shipping rack being supported by said support shelf and support wing and with the casters out of ground engagement, the troughs being spaced apart a distance to accommodate reception of the spaced apart fingers of a fork lift transversely of the pallet so that the shipping rack may be lifted from the support pallet, and the wing being positioned with respect to the space beneath the support shelf to accommodate the reception of one finger of said fork lift transversely therebeneath with the other finger of said fork lift being received transversely beneath the support shelf so that the support pallet and shipping rack may be lifted as a unit while maintaining the same spacing of the fork lift fingers as that used for lifing the shipping rack.

2. The combination as defined in claim 1, further characterized in that said troughs are V-shaped in cross section.

3. The combination as defined in claim 1, further characterized in the provision of a second generally flat support wing extending from the other trough in the same plane as that defined by the support shelf.

* * * * *